United States Patent [19]

Bouy et al.

[11] 4,064,032

[45] Dec. 20, 1977

[54] ELECTROLYSIS CELL OF MODULAR STRUCTURE AND HAVING BIPOLAR ELEMENTS

[75] Inventors: Pierre Bouy, Enghien les-Bains; Hubert de Lachaux, Courbevoie; Michel Conan, Rueil Malmaison, all of France

[73] Assignee: Rhone-Poulenc Industries, Paris, France

[21] Appl. No.: 600,077

[22] Filed: July 29, 1975

[30] Foreign Application Priority Data

July 29, 1974 France ..... 74.26234

[51] Int. Cl.[2] ..... C25B 1/16; C25B 1/26; C25B 9/00

[52] U.S. Cl. ..... 204/270; 204/268; 204/279; 204/286; 204/297 R

[58] Field of Search ..... 204/279, 252, 253, 254, 204/261, 262, 263, 264, 266, 267, 268, 269, 270, 272, 271; 292/145, 175, 341.15

[56] References Cited

U.S. PATENT DOCUMENTS

| | | | |
|---|---|---|---|
| 119,180 | 9/1871 | Read et al. | 292/175 |
| 390,507 | 10/1888 | Morton | 292/341.15 |
| 1,464,689 | 8/1923 | Allan | 204/254 |
| 2,487,428 | 11/1949 | Earnest | 292/341.15 |
| 3,236,760 | 2/1966 | Messner | 204/254 X |
| 3,287,251 | 11/1966 | Horne et al. | 204/268 X |
| 3,749,661 | 7/1973 | Cook et al. | 204/279 X |
| 3,752,757 | 8/1973 | Stephenson et al. | 204/254 X |
| 3,835,020 | 9/1974 | Galneder | 204/268 |
| 3,875,040 | 4/1975 | Weltin et al. | 204/254 X |

OTHER PUBLICATIONS

Kienholz, "Outlook for Chlorine-Caustic Production", CEP, vol. 70, No. 3, p. 63, Mar. 1974.

Hampel, "Encyclopedia of Electrochemistry", (1964), p. 249.

Hooke Chem. Corp. Publication (1959) Bulletin 20-A.

*Primary Examiner*—Arthur C. Prescott

[57] ABSTRACT

Electrolysis cell having bipolar elements arranged side by side are characterized by an assembly of modules, the cohesion of which is ensured by assembly means from module to module. The cell can be applied in particular to the electrolysis of solutions of alkali salts.

6 Claims, 3 Drawing Figures

ELECTROLYSIS CELL OF MODULAR STRUCTURE AND HAVING BIPOLAR ELEMENTS

BACKGROUND OF THE INVENTION

The present invention relates to an electrolysis cell having bipolar elements for the electrolysis of, in particular, solutions of alkali salts.

Electrolysis cells having bipolar elements have been known for a long time. They have the advantage of a compact structure and thus a saving in space and facilitated electricity supply due to the fact that unit cells are connected in series.

Nevertheless, despite their obvious advantages such cells are still relatively little used. This is very largely due to the difficulties in production, particularly difficulties of a technical nature. In actual fact it is necessary to maintain a small interpolar distance. This means that large plane surfaces are arranged opposite one another and as parallel as possible, but also with a high degree of impermeability between each compartment and each element, which is very difficult to effect with solutions as corrosive as the brines treated in this type of cell.

In addition, the passage of a current and the circulation of gas and liquid occur in these cells, which means that the gases must be able to escape satisfactorily and the liquids must be able to circulate despite the small size of the anode and cathode compartments. Now, it is known that it is not easy to satisfy both the mechanical and electrical requirements at one and the same time.

Several types of solution have been proposed in order to obtain bipolar elements which are both in the same plane and allow current to pass, either by trying to separate the electrical and mechanical functions or by making the base plate of the electrode act just as a support, as in de Lachaux et al. U.S. application Ser. No,. 478,605, filed June 12, 1974 now U.S. Pat. No. 3,980,545. In that application, the current leads act as stiffeners and ensure the planarity of the anode and cathode parts with respect to the base plate.

Another serious difficulty encountered in this field of technology is the question of impermeability between the various units constituting the cell.

A solution which is often adopted is to arrange a sealing member between two consecutive rigid units. This simple solution unfortunately does not satisfy the requirements which are met in commercial practice and this is why it has recently been proposed to give the frames a particular shape, just resting against adjacent frames and having at least one recess in which at least one sealing member is arranged.

However, for such a solution to give good results it presupposes that the various bipolar elements are put in place correctly and that the clamping or securing forces are constant and uniformly distributed. This requirement follows from the very technology of the cell. Now, up to the present time the technologies of cells having bipolar elements can be classified in two large categories. One of these is the so-called filter press type. In this, various elements are secured to one another by jacks or tie-bars joining the end elements.

However, this arrangement has two serious disadvantages the first being that it is practically impossible to obtain a uniform clamping force between all the pairs of elements. Furthermore, any slight lack of planarity will have repercussions from element to element. The result is that even with sealing means which are useful in themselves, this arrangement is practically impossible to implement satisfactorily with a simple installation and at reasonable cost. The other disadvantage is due to the fact that in the event of deterioration of an element and its sealing means, it is necessary to stop operations and disassemble the cell.

Attempts have been made to improve this arrangement by no longer having a vertical assemblage, but instead having a horizontal stacking system. In this case, the removal of gases formed during electrolysis becomes more difficult.

The second category of cells has an arrangement which, by analogy, can be termed an accumulator type arrangement. In this case various elements are placed side by side in a tank. Although the positioning can then be guaranteed precisely, this is no longer the case with the clamping, and assembly, disassembly and impermeability are not completely satisfactory.

Accordingly, it is an object of the present invention to overcome the disadvantages of the prior art.

It has now been found that these disadvantages can be obviated simply and unexpectedly by means of the cell, which is an object of the present invention, characterised in that the cell consists of an assemblage of units whose cohesion is ensured by assembly means from unit to unit.

Other objects will be apparent to those skilled in the art from the present description taken in conjunction with the appended drawings, in which.

GENERAL DESCRIPTION OF THE INVENTION

In the cell construction of the invention, an assemblage of units is provided so that cohesion is provided from bipolar element to bipolar element. The said assembly means are advantageously integral with each unit. These assembly means simply consist of positioning means, attachment means, and clamping or securing means.

The positioning means may consist of small wheels or rollers arranged under each unit, but any other means such as runners, slide means or air-cushion system may be used.

Likewise, any bolt or pin system, etc., may be used as attachment means, and any screw system, for example, tie-bars or jacks, may be used as clamping or securing means, but according to a preferred embodiment which forms a part of the present invention, these attachment and clamping means consist of at least one element integral with each unit and having a movable system connected to preadjustable elastic linking means. The said system comprises a female element which can mate with a male element able to move in an assembly integral with an adjacent unit, the said male and female elements being adapted so that the insertion of the male element into the female element produces compression of the elastic means carried by the movable system.

The said assembly is effected in a simple manner from bipolar element to bipolar element.

SPECIFIC DESCRIPTION OF THE INVENTION

The present invention will be more easily understood with the aid of the following examples given by way of example, and which are in no way limitative.

Figure 1:
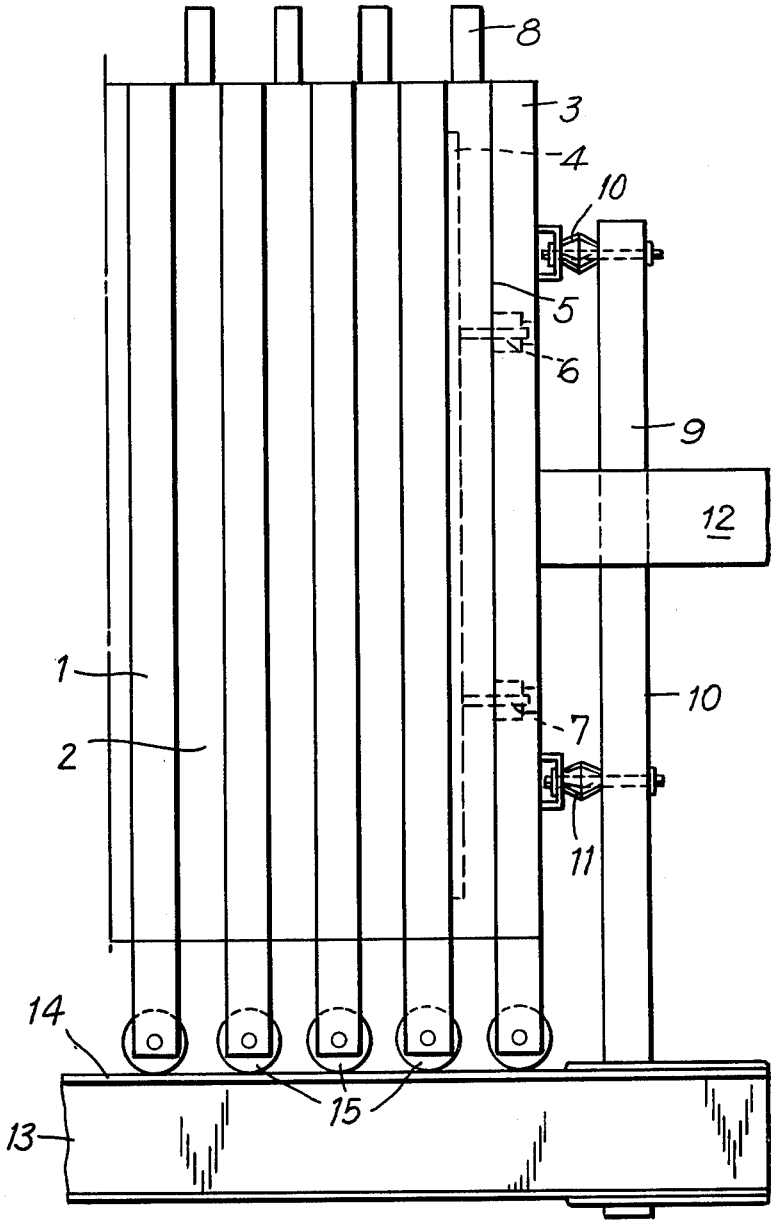
FIG. 1 is an elevation view of the apparatus of the invention showing a plurality of bipolar elements.

As may be seen from FIG. 1 of the drawings a cell according to the present invention comprises a plurality of bipolar elements including a cathode frame 1 and an anode frame 2. These frames are arranged side by side. According to the embodiment illustrated in FIG. 1, the end frame is an anode-carrying frame 3 on which is mounted an anode 4 via a base plate 5, stiffeners 6 and 7 serving as current leads and conforming to the bipolar elements described in aforesaid U.S. application Ser. No. 478,605.

Each cathode frame is of a rigid material, such as mild steel covered with a material resistant to corrosion, such as for example a titanium sheet or a sheet of another film-forming metal. The anode frames are similar to the cathode frames except that they are of molded rigid polyester and are higher because of the presence of separators 8.

The anode-carrying frame 23 is made integral with an end support 9 via electrically insulating connecting members such as 10 and 11, electrical connection being ensured by a current lead 12.

The bipolar elements rest on a concrete base 13, via rails, such as 14, and small wheels such as 15 arranged at the lower end of each cathode frame 1.

Figure 2:
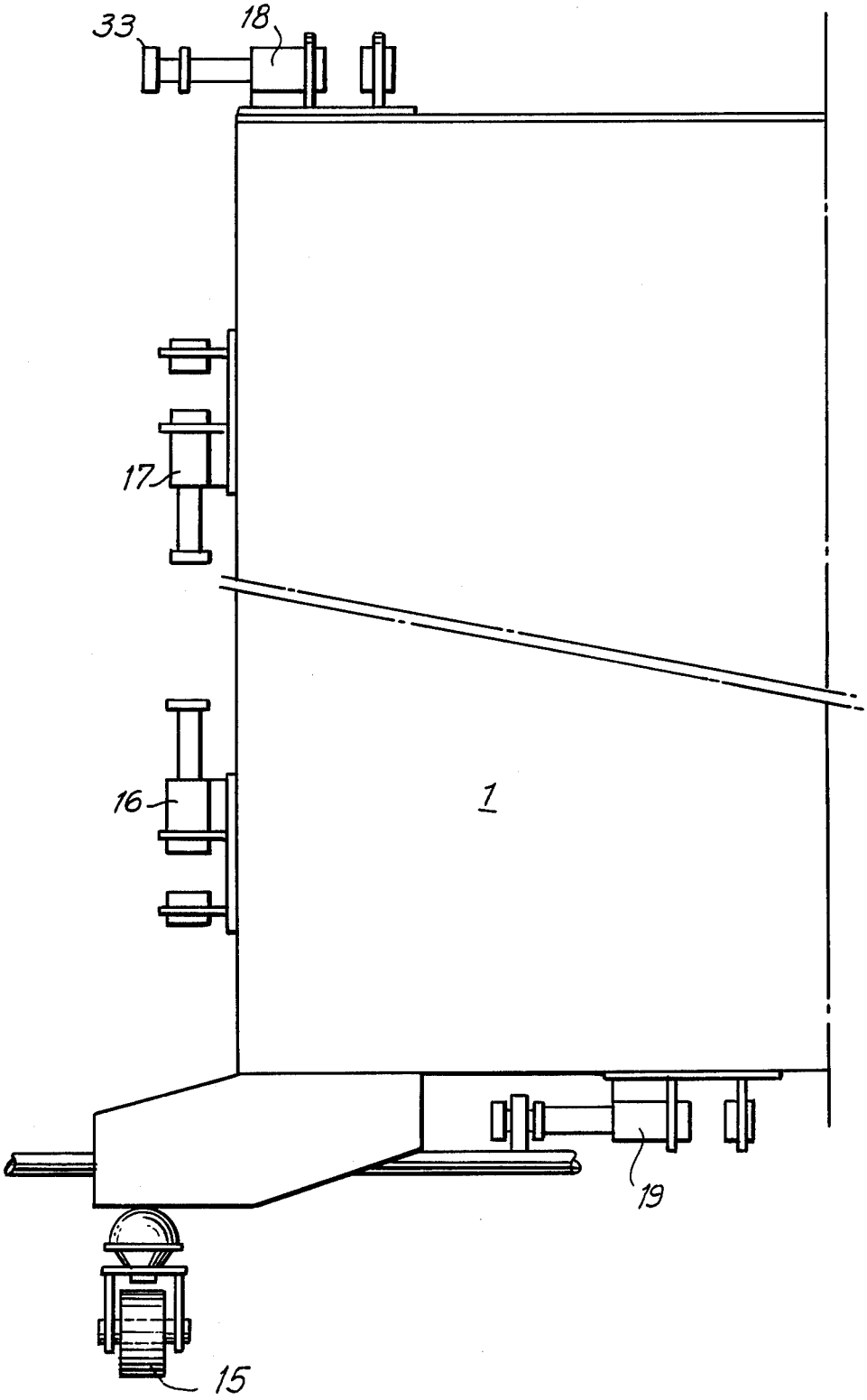
FIG. 2 is a front view of a bipolar element showing more particularly the arrangement of the assembly means according to the invention.

As may be seen from FIG. 2, each cathode frame has, in addition to a small wheel 15, attachment and clamping systems such as 16, 17, 18 and 19 arranged over the whole circumference.

Figure 3:
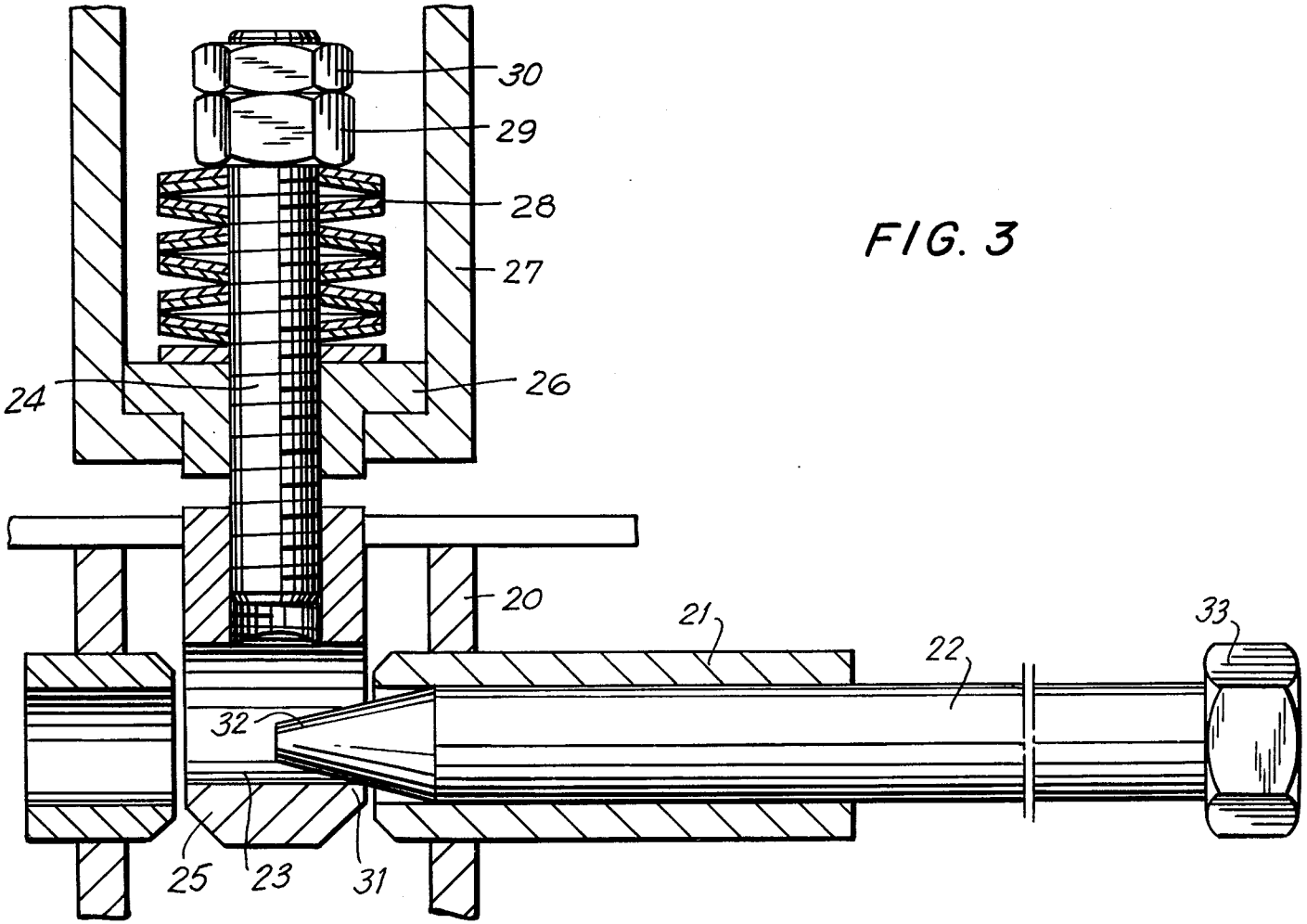
FIG. 3 is a sectioned view of a device illustrating one embodiment of an attachment and clamping means according to the present invention.

Such an attachment and clamping system is shown in more detail in FIG. 3. The said system comprises a member 20 integral with the cathode frame which itself carries a sheath 21 in which a spindle 22 may move. The spindle 22 may reach the interior of a pipe 23 arranged within a movable assembly consisting of a rod 24 and a member 25. The rod 24 may slide inside an insulating sleeve 26 arranged at the end of a member 27 similar to the member 20 and integral with the adjacent cathode frame.

The clamping and attachment of the frames is effected by means of a preadjustable bolt system consisting of a leaf spring 28 whose tension is predetermined by a nut 29 and a counter-nut 30 screwed on the rod 24, on the one hand, and by means of the hollow member 25 on the other hand, to the edge 31 of which the conical end 32 of the spindle 22 can just slide during clamping.

The preadjustable bolt system is particularly useful as regard the attachment means arranged on the upper and lower parts of the cell. In fact, the upper part of a cell is blocked in particular by the presence of separators, with the result that there is no possibility of access for an operative and thus no possibility of regulating the element itself. Thus, by virtue of the bolt system according to the invention, the clamping and attachment of the elements can be effected simply by manipulating the head 33 of the spindle 22.

Of course, instead of using a system sliding inside the sheath 21 for the spindle 22, it is possible to use a threaded spindle and replace the movable system consisting of the members 24, 25 by any movable arrangement combined with a preadjustment system which may consist of any elastic connecting means in place of the leaf spring 28 and the nut 29 and counter-nut 30.

The present invention is naturally not limited to the embodiments which have just been described, and anode frame to cathode frame connections, or anode frame to anode frame connections, or a connection via small groups of elements forming units, may be provided.

Thus, by connecting movable positioning means such as small wheels or slide means, and self-clamping and preadjustable attachment means to the elements themselves, it is possible to obtain a very precise connection and good contact between elements, which is absolutely necessary for a good industrial operation. Moreover, the simplicity of the means used and the unit or modular concept enables an element or group of elements to be replaced, which is also very important in battery production lines since it is vital that any non-operation of an element should not stop the whole production.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. An electrolysis cell having bipolar elements arranged side by side, comprising an assemblage of a plurality of units of bipolar elements whose cohesion is ensured by individual assembly means on each unit, each said assembly means joining each unit to the next, said assembly means comprising positioning, attachment and clamping means.

2. An electrolysis cell according to claim 1, wherein said positioning means consist of wheels attached to the end of each said unit of bipolar elements.

3. An electrolysis cell according to claim 2, wherein said wheels ride on rails fixed on the base of said cell.

4. An electrolysis cell according to claim 1 wherein said attachment and clamping means consist of at least one element integral with each unit having a movable system connected to preadjustable elastic linking means, comprising a female element which can mate with a movable male element in an assembly integral with an adjacent unit, the said male and female elements being adapted so that the insertion of the male element into the female element produces compression of the elastic means carried by the movable system.

5. An electrolysis cell according to claim 4 wherein said elastic linking means consist of a leaf spring.

6. An electrolysis cell according to claim 4, wherein said male element is threaded.

* * * * *

UNITED STATES PATENT AND TRADEMARK OFFICE

CERTIFICATE OF CORRECTION

PATENT NO. : 4,064,032

DATED : December 20, 1977

INVENTOR(S) : Pierre Bouy et al.

It is certified that error appears in the above-identified patent and that said Letters Patent are hereby corrected as shown below:

Column 3, line 24, delete "23" and replace with -- (3) --.

Signed and Sealed this

Fourth Day of April 1978

[SEAL]

Attest:

RUTH C. MASON
Attesting Officer

LUTRELLE F. PARKER
Acting Commissioner of Patents and Trademarks